United States Patent [19]

McWhorter et al.

[11] 4,162,917

[45] Jul. 31, 1979

[54] METHOD AND COMPOSITION FOR TREATING MOLTEN FERROUS METALS TO PRODUCE NODULAR IRON

[75] Inventors: Robert D. McWhorter; Perry C. Jones, both of Birmingham, Ala.

[73] Assignee: Schuler Industries, Inc., Birmingham, Ala.

[21] Appl. No.: 920,365

[22] Filed: Jun. 29, 1978

[51] Int. Cl.[2] ..... C21C 7/02

[52] U.S. Cl. ..... 75/130 R; 75/53; 75/58

[58] Field of Search ..... 75/53, 58, 130 R

[56] References Cited

U.S. PATENT DOCUMENTS 4,040,818 8/1977 Clegg ..... 75/58

*Primary Examiner*—P. D. Rosenberg

*Attorney, Agent, or Firm*—Woodford R. Thompson, Jr.

[57] ABSTRACT

A method and composition for treating molten metals and alloys of the iron group with a reactive metal to produce nodular iron. The composition is in the form of a self-contained body formed by compressing a mechanical mixture of particles of a reactive metal, particles of synthetic graphite and a binder with the particles of synthetic graphite surrounding and protecting the particles of reactive metal so that there is controlled release of the reactive metal into the molten metal upon submerging the self-contained body into the molten metal.

12 Claims, No Drawings

METHOD AND COMPOSITION FOR TREATING MOLTEN FERROUS METALS TO PRODUCE NODULAR IRON

BACKGROUND OF THE INVENTION

This invention relates to a method and composition for treating molten metals and alloys of the iron group with a reactive metal to produce nodular iron and more particularly to the use of low boiling point alkali and alkaline earth reactive metals for treating molten iron and alloys thereof to produce nodular iron and effect desulfurization thereof.

As is well known in the art to which our invention relates, many methods have been proposed for treating molten metals and alloys of the iron group with a reactive metal to produce nodular iron and to desulfurize iron. One method for introducing magnesium into the molten iron has been through the use of an iron, silicon, magnesium alloy. This alloy has been added by placing a cushion of cold metal in the ladle on top of the iron silicon magnesium alloy to minimize the loss of magnesium and contain the volatility within the vessel. This method is disadvantageous when the silicon content of the base metal is high and the addition of more silicon would put the metal out of chemical specification. Accordingly, this method of introducing magnesium into the molten metal is used when a reduced quantity of magnesium is desired to nodularize and when silicon will not create a problem. That is, returns to melt must be closely controlled due to high silicon content of the iron silicon magnesium alloy.

Another method of introducing magnesium into molten iron has been to immerse pure magnesium into the molten iron with a plunging bell within a suitable vessel. This is employed when a large quantity of iron needs to be desulfurized and nodularized. The use of pure magnesium is undesirable because of the fast and violent reaction which takes place when the pure magnesium is immersed in molten iron. Not only does the violent reaction cause a safety hazard but there is a high loss of magnesium due to its volatility. Also, expensive equipment is required to handle the pure magnesium.

Another method of introducing magnesium into molten iron has been through the use of a porous refractory body, such as porous coke and porous graphite, which are impregnated with magnesium. That is, the porous refractory body is dipped in the molten magnesium whereby the magnesium impregnates the porous body. Such a method is disclosed in the Snow U.S. Pat. No. 3,321,304. The porous refractory body impregnated with magnesium is immersed in the molten iron by employing a plunging bell or the like. This method of introducing magnesium into molten iron is employed where a greater quantity of magnesium is needed and no other alloys are desired. This method is also employed when the carbon content in the coke can be advantageous. While the reaction time with this method is very slow, there is a violent reaction upon initially immersing the magnesium impregnated body into the molten iron whereby there is a great loss of magnesium due to volatility. Other disadvantages in this method are that expensive equipment is required to handle the violent reaction and undissolved coke must be skimmed from the ladle.

Another method of introducing magnesium into molten iron is disclosed in the Easwaran et al U.S. Pat. No. 3,902,892. In accordance with this method, a mass of scrap ferrous metal pieces is impregnated with magnesium. This body impregnated with magnesium must also be introduced into the molten iron by use of a plunging bell assembly or the like. This method is employed where a greater quantity of magnesium is desired and the steel turnings contained within the product can be utilized. There are disadvantages in this method due to the fact that a violent reaction occurs when the product is immersed in the molten iron and also expensive equipment is required due to volatility.

In addition to the above methods of introducing magnesium into molten iron, there is a German alloy, "VL 55", which contains approximately 30–35% magnesium along with silicon, rare earth and other ingredients. The product is introduced into the molten iron by employing a plunging bell. This product is employed when a greater quantity of magnesium is desired and where silicon, rare earth and other ingredients are desired. A disadvantage in this method is that a violent reaction occurs when the product is introduced into the molten metal, thereby requiring expensive equipment.

Another method of introducing magnesium into molten iron is by employing the inmold process wherein the magnesium is added to the melt through chambers in the mold gating system rather than in the ladle before the casting is poured. The nodulizing agent is a cast to shape iron, silicon, magnesium alloy or a mechanical mixture of granular ferrosilicon and atomized magnesium formed into pellets. Accordingly, two metallics are combined in pellet form. This latter process is mentioned in "NEWSLETTER" published by The National Magnesium Association, May 1978, page 5. This publication mentions other attempts to use elemental magnesium by means, such as pneumatic injection, refractory coatings, external magnesium vaporizers, special pockets in refractory-lined reactor vessels, and pressure treatment systems. The refractory coatings heretofore employed have been merely external coats applied to solid lumps of magnesium, such as a dip-wash coat or a coat applied in accordance with the Snow U.S. Pat. No. 3,321,304, mentioned above.

SUMMARY OF THE INVENTION

In accordance with our invention, we provide a method and composition for treating molten metals and alloys of the iron group with a reactive metal to produce nodular iron and effect desulfurization. The composition comprises a compressed bonded mechanical mixture of particles of a reactive metal, such as magnesium, sodium, calcium, rubidium, cerium and alloys or mixtures thereof together with particles of synthetic graphite and a binder. Other metals of the alkali, alkaline earth or rare earth group may also be employed. The particles of synthetic graphite are of a size to surround and protect the particles of reactive metal. That is, the particles of synthetic graphite are small enough to fill the interstices between the particles of reactive metal whereby the particles of reactive metal are surrounded by a refractory material which must first go into solution or be dispersed before the reactive metal comes in direct contact with the molten iron. Accordingly, our improved composition and method is quite different from the method and compositions disclosed in the Snow U.S. Pat. No. 3,321,304 and the Easwaren et al U.S. Pat. No. 3,902,892 wherein the reactive metal, such as magnesium, must first go into solution before the porous refractory body is contacted directly by the molten iron. By employing synthetic graphite as a carrier for the reactive metal, we not only derive a refractory body that surrounds the reactive metal particles whereby the release thereof is controlled but also provide a carrier in synthetic graphite which increases the carbon in the treated metal. Heretofore, it has been thought by most foundry metallurgists that the use of graphite as a carbon raiser was satisfactory but they challenged it as an innoculant. The main objection was that metallurgists were of the opinion that flakes would be formed in the iron if graphite is introduced into the molten iron as an innoculant. In accordance with our invention, we thus provide a protective refractory carrier for the particles of reactive metal, such as magnesium, which is also very beneficial as an innoculant and as a carbon raiser and at the same time our improved protective refractory controls volatility whereby the reaction takes place in a minimum of time without creating a hazardous condition and with a minimum loss of the reactive metal.

DETAILED DESCRIPTION

In accordance with our invention, we provide a composition and method for use in the treatment of molten metals and alloys of the iron group to effect the formation of nodular iron and desulfurize iron which comprises a compressed bonded mechanical mixture of particles of a reactive metal, particles of synthetic graphite and a binder. The particles of reactive metal may be particles of magnesium, sodium, calcium, rubidium, cerium, and mixtures or alloys thereof. Other metals of the alkali, alkaline earth, or rare earth group may also be employed. The term "synthetic graphite", as set forth in this application is intended to define the crystalline carbon product produced by heating amorphous forms of carbon above 3990° F. in an electric furnace. Above this temperature, crystals are formed. In the trade, synthetic graphite is often referred to as "electrographite" or "artifical graphite". The particles of synthetic graphite mixed with the reactive metal are of a size to surround and protect the particles of reactive metal whereby the release of the reactive metal in the molten metal is controlled upon submerging the compressed bonded mechanical mixture into the molten metal. The mechanical mixture of synthetic graphite and a reactive metal, such as magnesium, may be in the form of a powder, small slugs or turnings and other various shapes. In actual practice, we have found that satisfactory results are obtained where the particles of synthetic graphite and the particles of reactive metal are no greater than a size to pass through a screen having an opening between meshes of approximately ½ inch. Preferably, the size of the particles of synthetic graphite are no greater than a size to pass through a screen of approximately 8 mesh. Also, it is preferred that the particles of reactive metal be no greater than a size to pass through a screen having openings between meshes of approximately ¼ inch.

The particles of reactive metal and the particles of synthetic graphite are mixed with a suitable binder and pressed into a desired shape which will suggest itself to one skilled in the art to which our invention relates. The binder employed depends upon the particular application. In actual practice, we have found that sodium silicate is an excellent binder due to the fact that it provides a good bond and has sufficient strength and at the same time will not create slag. Also, clays, synthetic resins, phosphates, glutrin, cereal, cornstarch, sugar and the like may be used as binders. The mechanical mixture of particles of reactive metal and particles of synthetic graphite together with the binder are placed in a suitable press, such as a hydraulic press, and are pressed to form a compressed, bonded product. The size of the product depends upon the application. For example, the compressed bonded product may be in the form of a block 3¼×3¼ by 1¼ inches. The pressure employed to form the blocks also depends upon the application due to the fact that the density of the composition would effect the reaction time. The pressure could vary from 1,200 to 2,400 pounds per square inch.

Since our improved composition is a mechanical mixture, and not an alloy, any combination of reactive metal, such as magnesium, and synthetic graphite can be mixed. Also, any quantity of rare earth can be mixed with the reactive metal and the synthetic graphite. It should be noted that our improved compressed bonded mechanical mixture should be dry at the time it is submerged into molten metal due to the fact that any moisture in the product would cause violent reactions or explosions during and after the submerging operation. Also, the bulk density of the compressed product should be maintained the same. Also, in accordance with our invention, sulfur is effectively removed with less formation of slags than is encountered with other desulfurizing materials. Furthermore, since insoluble oxides and sulfides of magnesium are formed in accordance with our method of treatment, slag attack on the furnace lining is greatly minimized. It will also be understood that our improved composition may be added to molten metal in a reactor vessel as well as to a furnace itself.

In use, our improved compressed bonded mechanical mixture of particles of a reactive metal and synthetic graphite is immersed in molten iron with suitable means, such as a plunging bell. Also, any other suitable holddown method other than a plunging bell could be employed. Since the synthetic graphite refractory is a carrier for the reactive metal and surrounds the particles of reactive metal to protect the same until the reactive metal goes into solution, we provide for controlled release of the particles of reactive metal whereby the reaction is slow enough to prevent a violent reaction in the molten metal and at the same time the reaction takes place in a minimum of time. In actual practice, we have found that the reaction can take place in less than one minute.

By employing synthetic graphite as a refractory carrier for the particles of reactive metal, we provide a source of carbon which is at a higher purity than coke, thus eliminating slag and ash content and other inherent characteristics of coke. Since synthetic graphite is a carbon raiser, there is a gain in carbon rather than a loss whereby there is a substantial cost saving. Also, by providing a mechanical mixture of synthetic graphite and a reactive metal, the amount of the reactive metal added may be varied to a customer's specification. Not only is synthetic graphite an excellent refractory material which will withstand extremely high temperatures, but synthetic graphite is extremely soluble in molten iron. Accordingly, synthetic graphite may be readily mixed with sized particles of a reactive metal, such as magnesium, and contained by adding a binder to provide the protective refractory material around the reactive metal to accurately control the volatility within the vessel and at the same time improve the yield of reactive metal in the molten iron. It will thus be seen that where our improved product is employed, the volatility can be readily controlled by varying the size, shape, density, composition and reaction time. For example, the smaller the particles of synthetic graphite, the more readily it will be absorbed by the molten metal. Since synthetic graphite has a porosity ranging from approximately 20 to 30%, the crushed synthetic graphite employed in accordance with our invention would not be impregnated by the reactive metal. That is, the synthetic graphite would form a protective, refractory lining around the particles of reactive metal whereby the protective layer of synthetic graphite would have to go into solution or be dispersed prior to the reactive metal coming into actual contact with the molten iron.

The following examples illustrate that our mixture of synthetic graphite and a reactive metal may be compressed and then the product used alone or in combination with other compositions or alloys to obtain desired results from varied base iron analysis.

EXAMPLE I

Production tests were run on a first group of samples to establish the feasilility of the method. Iron was poured into a stationary plunging ladle where approximately 1,200 pounds of molten iron was treated with a treating agent comprising 11 to 11.5 pounds of magnesium impregnated coke as disclosed in the Snow U.S. Pat. No. 3,321,304, approximately 4 ounces of mischmetal and approximately ½ pound of calcium carbide. The treating agent was formed into a cylindrical body 8 inches in diameter and 7½ inches high and submerged into the molten iron by a clay graphite bell and stem assembly.

For the first test, 25% (based on the magnesium content) of the magnesium coke treating agent described above was replaced by our improved treating composition described above comprising compressed particles of synthetic graphite and magnesium. The magnesium-coke treating agent was calculated at 44% contained magnesium. The synthetic graphite-magnesium composition, calculated at 20% contained magnesium, was pressed at 1,500 p.s.i. into blocks 3 inches × 3 inches × 1 inch with a ¾ inch hole in its center. These blocks weighed approximately 8 ounces.

A second test was made using 50% magnesium-coke treating agent and 50% of the synthetic graphite-magnesium composition, based on contained magnesium.

Because of the small size of the container and the high sulfur content of the base metal, it was not possible to treat the ladle with 100% of the synthetic graphite-magnesium composition.

The data in Table 1 shows the results from the first group of samples. The base iron chemistry was from a random production sample as was the 100% magnesium impregnated coke sample. The two samples using the synthetic graphite-magnesium composition showed magnesium recovery comparable to the regular production sample.

A second group of tests were made using 50% of the magnesium-coke treating agent and 50% of the synthetic graphite-magnesium composition and using 100% of the magnesium coke treating agent. The compressed synthetic graphite-magnesium composition used in this group of tests waas 3 inches × 3 inches × 1½ inch with a ¾ inch hole in its center and weighed approximately 12 ounces with contained magnesium being approximately 40%. A combination of 1% cereal and 2% sodium silicate was used as a binder. The results of the second group of tests and a direct comparison of our synthetic graphite-magnesium composition and the magnesium-coke treating agent are shown in Tables 2 and 3.

TABLE NO. 1

| | | C | Si | S | P | Mn | Mg |
|---|---|---|---|---|---|---|---|
| | Base Iron | 3.48 | 0.90 | 0.124 | 0.022 | 0.37 | |
| 25% G.M. | 1st of Ladle | 4.00 | 2.26 | | | | 0.034 |
| 75% M.C. | Last of Ladle | 4.02 | 2.00 | | | | 0.019 |
| | 100% M.C. | 3.77 | 2.32 | | | | 0.030 |
| 50% G.M. | 1st of Ladle | 3.77 | 2.23 | | | | 0.036 |
| 50% M.C. | Last of Ladle | 3.96 | 2.35 | | | | 0.026 |

TABLE NO. 2

| | | C | Si | S | P | Mn | Mg |
|---|---|---|---|---|---|---|---|
| No. 1 | Base Iron | 3.64 | 1.85 | 0.108 | 0.029 | 0.39 | — |
| No. 1 | 50% G.M. 50% M.C. | 3.72 | 2.89 | | | 0.35 | 0.031 |
| No. 2 | Base Iron | 3.71 | 1.76 | 0.108 | 0.041 | 0.38 | — |
| No. 2 | 100% M.C. | 3.71 | 2.94 | | | 0.37 | 0.045 |

In the above tables, G.M. refers to our compressed bonded mixture of synthetic graphite and magnesium and M.C. refers to magnesium impregrated coke as disclosed in the Snow patent No. 3,321,304.

TABLE NO. 3

| | Yield Strength psi | Tensile Strength psi | Elong.% | BHN | Impact Ft/Lbs |
|---|---|---|---|---|---|
| No. 1 50% G.M.-50% M.C. | 53,600 | 81,200 | 13.0 | 196 | 4 |
| No. 2 100% M.C. | 51,400 | 75,400 | 18.5 | 192 | 5 |

In the above tables, G.M. refers to our compressed bonded mixture of synthetic graphite and magnesium and M.C. refers to magnesium impregrated coke as disclosed in the Snow patent No. 3,321,304.

The following tests were made wherein our synthetic graphite-magnesium composition was employed. The molten iron was treated by submerging the treating agents or compositions into an enclosed container.

Test No. 1

| Iron taken from Number 1 furnace. | | |
|---|---|---|
| Weight of iron treated | | 7,600 lbs. |
| G. M. (25% mg.) | | 36.5 lbs. |
| M. C. (43% mg.) | | 12.5 lbs. |
| Treating time | | 120 seconds |
| Treating temperature | | 2560° F. |
| Lbs. of mg. used | | 9.68 lbs. |
| Iron Analysis | Base | Treated |
| C | 3.80% | 3.91% |
| S | .040% | .009% |
| Si | 2.13% | 2.37% |
| Mn | .70% | .64% |
| Cr | .049% | 0.48% |
| Mg | | .013% |

Laboratory examination of the treated iron showed 60% nodularity and 60% pearlite in the metal structure.

Test No. 2

| Iron taken from Number 1 furnace. | | |
|---|---|---|
| Weight of iron treated | | 7,600 lbs. |
| G. M. (25% mg.) | | 43 lbs. |
| Treating time | | 20 seconds |
| Treating temperature | | 2520° F. |
| Lbs. of mg. used | | 10.75 lbs. |
| Iron Analysis | Base | Treated |
| C | 3.80% | 4.00% |
| S | .040% | .010% |
| Si | 2.13% | 2.38% |
| Mn | .70% | .64% |
| Cr | .049% | .048% |
| Mg | | .009% |

Microscopic examination of the treated metal showed 90% nodularity and 65% pearlite.

Test No. 3

| Iron taken from Number 3 furnace. | | |
|---|---|---|
| Weight of iron treated | | 7,600 lbs. |
| G. M. (25% mg) | | 17 lbs. |
| Deflake (25% mg) | | 33 lbs. |
| Treating time | | 50 seconds |
| Treating temperature | | 2480° F. |
| Lbs. of mg. used | | 12.50 lbs. |
| Iron Analysis | Base | Treated |
| C | 3.97% | 4.01% |
| S | .023% | .008% |
| Si | 2.11% | 2.43% |
| Mn | .67 % | .66 % |
| Cr | .049% | .049% |
| Mg | | .030% |

Microscopic examination of the treated metal showed 100% nodularity and 90% pearlite.

Since the normal magnesium charge in the treating container was 12.50 pounds, it was not possible on Tests No. 2 and No. 2 to get sufficient material in the container to result in 12.50 pounds of actual magnesium per charge. It is believed that this is the reason why 100% nodularity was not obtained in these two tests. The compressed synthetic graphite-magnesium bodies used in these tests were 3¼ inches × 3¼ inches × 1¼ inch and weighed approximately 10 ounces.

In the above examples, G. M. refers to our compressed bonded mixture of synthetic graphite and magnesium, M. C. refers to magnesium impregnated with coke as disclosed in the Snow U.S. Pat. No. 3,321,304 and "Deflake" refers to a mass of scrap ferrous metal pieces impregnated with magnesium as disclosed in the Easwaran et al U.S. Pat. No. 3,902,892.

From the foregoing it will be seen that we have provided an improved composition and method for treating molten metals and alloys of the iron group to effect the formation of nodular iron and at the same time is particularly adapted for the purpose of desulfurizing iron. Also, we accomplish these results with a reaction time much less than that required with prior art methods and compositions. Furthermore, the particle sizes of our synthetic graphite and magnesium may be varied, the density may be varied and the shape may be varied so as to provide flexibility in production whereby our compressed product may be varied to meet customer specifications.

We wish it to be understood that the limited number of examples herein disclosed should not be interpreted as an attempt to define or limit the scope of this invention for it will be readily apparent to those skilled in this art that changes and modifications may be made without departing from the spirit of the invention.

What is claimed is:

1. In a composition for use in the treatment of molten metals and alloys of the iron group by submerging the composition into molten metal to effect the formation of nodular iron: a compressed bonded mechanical mixture comprising, (a) particles containing a reactive metal selected from the group consisting of alkali, alkaline earth, rare earth metal and alloys and mixtures thereof, (b) particles of soluble synthetic graphite, (c) a binder bonding said particles containing reactive metal and said particles of soluble synthetic graphite together, and (d) said particles of soluble synthetic graphite being of a size to provide an initial protective refractory material around said particles containing reactive metal to control the release of said reactive metal into the molten metal upon submerging the compressed bonded mechanical mixture into the molten metal whereupon said soluble synthetic graphite is absorbed by the molten metal to cause nucleation of the graphite.

2. A composition for use in the treatment of molten metals and alloys of the iron group as defined in claim 1 in which the reactive metal is selected from the group consisting of magnesium, sodium, calcium, rubidium and cerium.

3. A composition for use in the treatment of molten metals and alloys of the iron group as defined in claim 1 in which the size of the particles containing synthetic graphite and the particles of reactive metal are no greater than a size to pass through a screen having openings between meshes of approximately ½ inch.

4. A composition for use in the treatment of molten metals and alloys of the iron group as defined in claim 1 in which the size of the particles of synthetic graphite are no greater than a size to pass through a screen of approximately 8 mesh.

5. A composition for use in the treatment of molten metals and alloys of the iron group as defined in claim 1 in which the size of the particles containing reactive metal are no greater than a size to pass through a screen having openings between meshes of approximately ¼ inch.

6. A method of treating molten metals and alloys of the iron group to effect the formation of nodular iron by submerging in a bath of molten iron a body of refractory material carrying a reactive metal with the temperature of the molten iron being greater than the boiling point of said reactive metal, and maintaining said body submerged in the molten iron while the latent heat of the molten iron vaporizes said reactive metal and causes said reactive metal to enter the iron metal and produce nodularization of the graphite therein, the improvement comprising the use of a body formed by compressing a mechanical mixture of particles of (a) soluble synthetic graphite, (b) particles containing a reactive metal selected from the group consisting of alkali, alkaline earth, rare earth metal and alloys and mixtures thereof and (c) a binder with said particles of soluble synthetic graphite surrounding and initially protecting said particles containing reactive metal upon submerging said body in molten iron to control the release of said particles containing reactive metal into the iron metal without violent reaction, whereupon said soluble synthetic graphite is absorbed by the molten metal to cause nucleation of the graphite.

7. A method of preparing a composition for use in the treatment of molten metals and alloys of the iron group as defined in claim 6 in which the reactive metal is selected from the group consisting of magnesium, sodium, calcium, rubidium and cerium.

8. A method of treating molten metals and alloys of the iron group as defined in claim 6 in which the size of the particles of soluble synthetic graphite and the particles containing reactive metal are no greater than a size to pass through a screen having openings between meshes of approximately ½ inch.

9. A method of treating molten metals and alloys of the iron group as defined in claim 6 in which the size of the particles of soluble synthetic graphite are no greater than a size to pass through a screen of approximately 8 mesh.

10. A method of treating molten metals and alloys of the iron group as defined in claim 6 in which the size of the particles containing a reactive metal are no greater than a size to pass through a screen having openings between meshes of approximately ¼ inch.

11. A method of preparing a composition for use in the treatment of molten metals and alloys of the iron group to effect the formation of nodular iron comprising the following steps:

(a) forming a mechanical mixture of (1) particles containing a reactive metal selected from the group consisting of alkali, alkaline earth, rare earth metal and alloys and mixtures thereof, (2) particles of soluble synthetic graphite and (3) a binder with said particles of soluble synthetic graphite and said binder surrounding said particles containing reactive metal, and (b) compressing said mixture to form a self-contained body having particles of soluble synthetic graphite surrounding and bonded to said particles containing reactive metal so that upon submerging said body in molten iron the particles of soluble synthetic graphite initially protect said particles containing reactive metal to release said particles containing reactive metal in a controlled manner whereby they enter the iron metal without violent reaction and said soluble synthetic graphite is absorbed by the molten metal to cause nucleation of the graphite.

12. A method of preparing a composition for use in the treatment of molten metals and alloys of the iron group as defined in claim 11 in which the reactive metal is selected from the group consisting of magnesium, sodium, calcium, rubidium and cerium.

* * * * *